US010828762B2

(12) United States Patent
Jablonski et al.

(10) Patent No.: US 10,828,762 B2
(45) Date of Patent: Nov. 10, 2020

(54) POWERED FASTENER DRIVING TOOL

(71) Applicant: Illinois Tool Works Inc., Glenview, IL (US)

(72) Inventors: David W. Jablonski, Wheaton, IL (US); Michael S. Popovich, Bartlett, IL (US)

(73) Assignee: Illinois Tool Works Inc., Glenview, IL (US)

( * ) Notice: Subject to any disclaimer, the term of this patent is extended or adjusted under 35 U.S.C. 154(b) by 171 days.

(21) Appl. No.: 16/103,348

(22) Filed: Aug. 14, 2018

(65) Prior Publication Data

US 2019/0091846 A1 Mar. 28, 2019

Related U.S. Application Data

(60) Provisional application No. 62/562,083, filed on Sep. 22, 2017.

(51) Int. Cl.
*B25C 1/18* (2006.01)
*B25C 1/00* (2006.01)

(52) U.S. Cl.
CPC ..... *B25C 1/184* (2013.01); *B25C 1/008* (2013.01); *B25C 1/186* (2013.01)

(58) Field of Classification Search
CPC ..... B25C 1/184; B25C 1/186; B25C 1/008; A22B 3/02
USPC ..... 227/120, 136, 135; 42/1.12
See application file for complete search history.

(56) References Cited

U.S. PATENT DOCUMENTS 3,565,313 A * 2/1971 Hans-Dieter Seghezzi ..... B25C 1/105 227/10
3,816,951 A 6/1974 Larsson
3,910,477 A 10/1975 Kavan
4,218,005 A 8/1980 Harris
4,655,380 A * 4/1987 Haytayan ..... B25C 1/143 227/10
4,687,126 A * 8/1987 Brosius ..... B25C 1/143 173/206
4,821,938 A * 4/1989 Haytayan ..... B25C 1/184 227/10

(Continued)

FOREIGN PATENT DOCUMENTS

GB 2 140 341 11/1984

OTHER PUBLICATIONS

International Search Report and Written Opinion from International Application No. PCT/US2018/047439, dated Nov. 29, 2018 (13 pages).

*Primary Examiner* — Thanh K Truong
*Assistant Examiner* — Katie L Gerth
(74) *Attorney, Agent, or Firm* — Neal, Gerber & Eisenberg LLP

(57) ABSTRACT

A powered fastener driving tool, and particularly a powder-actuated tool including a housing assembly and a strip receiver in the housing assembly, where the strip receiver includes a first guide groove defining wall, an opposing second guide groove defining wall, the first guide groove defining wall and the opposing second guide groove defining wall partially defining a guide groove and configured to guide a load strip to move through the strip receiver and the housing, and a plurality of residue collection pocket defining walls that partially define a plurality of spaced apart residue collection pockets.

15 Claims, 7 Drawing Sheets

(56) References Cited

U.S. PATENT DOCUMENTS

| | | | | |
|---|---|---|---|---|
| 5,251,532 | A * | 10/1993 | Frommelt | F41A 9/25 89/1.14 |
| 7,021,511 | B2 * | 4/2006 | Popovich | B25C 1/008 227/120 |
| 7,048,166 | B2 | 5/2006 | Pfister et al. | |
| 7,237,705 | B2 | 7/2007 | Gaudron | |
| 7,575,139 | B2 * | 8/2009 | Thompson | B25C 1/10 227/10 |
| 2005/0247751 | A1 * | 11/2005 | Wywialowski | B25C 1/08 227/136 |
| 2016/0222680 | A1 * | 8/2016 | Yang | B25C 3/00 |
| 2017/0136543 | A1 | 5/2017 | Hermann et al. | |

* cited by examiner

POWERED FASTENER DRIVING TOOL

PRIORITY

This application claims priority to and the benefit of U.S. Provisional Patent Application Ser. No. 62/562,083, filed Sep. 22, 2017, the entire contents of which are incorporated herein by reference.

BACKGROUND

Powered fastener driving tools are well known and commercially widely used throughout North America and other parts of the world. Powered fastener driving tools are typically electrically powered, pneumatically powered, combustion powered, or powder-actuated. Powered fastener driving tools are typically used to drive fasteners (such as nails, staples, and the like) to connect a first material, item, or workpiece to a second material, item, or workpiece.

Various known powered fastener driving tools include: (a) a housing; (b) a power source or supply assembly in, connected to, or supported by the housing; (c) a fastener supply assembly in, connected to, or supported by the housing; (d) a fastener driving assembly in, connected to, or supported by the housing; (e) a trigger mechanism partially in, connected to, or supported by the housing; (f) a power setting assembly in, connected to, or supported by the housing; and (g) a workpiece contactor or contacting element (sometimes referred to herein as a "WCE") connected to or supported by the housing. The WCE is configured to engage or contact a workpiece and to operatively work with the trigger mechanism such that the WCE needs to be depressed or moved inwardly a predetermined distance with respect to the housing before activation of the trigger mechanism causes actuation of the power fastener driving tool.

As mentioned above, various known powered fastener driving tools are powder-actuated. Powder-actuated tools are typically used in construction and manufacturing to attach one or more items or materials to hard substrates (such as steel or concrete) using fasteners. Powder-actuated tools typically eliminate the need to drill holes with a concrete drill bit or to use anchors and screws for such fastening applications. For example, powder-actuated tools are commonly used by electricians to attach conduit clips, electrical junction boxes, and various other items to concrete, masonry, and steel surfaces.

Powder-actuated tools use a controlled explosion created by a small chemical propellant charge to propel the fastener through both objects or materials. Powder-actuated tools are typically either high velocity or low velocity. High velocity powder-actuated tools typically cause the propellant charge to act directly on or directly drive the fastener. Low velocity powder-actuated tools typically cause the propellant charge to act on a piston that in turn acts on or drives the fastener. Fasteners used by powder-actuated tools are typically nails made of high quality, hardened steel, although they may be made from other materials.

Like other powered fastener driving tools mentioned above, known powder-actuated tools typically have a housing that supports a trigger that must be actuated to cause the firing pin of the powder-actuated tool to reach the load to fire it. Certain known powder-actuated tools also have a WCE element in the form of a muzzle safety interlock. If the muzzle is not pressed against a surface with sufficient force, the tool blocks the firing pin from reaching the load to fire it. This prevents the powder-actuated tool from discharging in an unsafe manner and causing the fastener to become an undesired projectile. Like other powered fastener driving tools mentioned above, various known powder-actuated tools also have a power setting switch supported by the housing. The power setting switch enables the operator to set the amount of power of the tool (from a range of different power settings) or the amount of force at which the tool will propel or drive the fastener.

In various known powder-actuated tools, residue from the powder actuated load going off collects in various places within the housing of the tool. For example, in many powder actuated tools where the powder actuated loads are collated in a strip and fed through the tool, the load strip advances through the tool, and particularly through a load strip receiver in the tool. The load strip receiver defines a load strip guide groove through which the powder actuated load strip is guided in a designated direction through the tool (such as from bottom of the tool to and through the top of the tool). As each of the powder actuated loads on the load strip is activated or goes off, small amounts of residue are discharged. This residue often builds up in the load strip guide groove of load strip receiver. Such residue build-up can cause damage to, can cause a breakage of, or can make the powder-actuated tool less functional, partially inoperable, or completely inoperable. For example, the buildup in the load strip guide groove of powder actuated residue can prevent the load strip from advancing or freely advancing though the load strip receiver and thus through the tool.

FIGS. 1 and 2 generally illustrate a known load strip receiver 20 of a known powder-actuated tool (not shown). The load strip receiver 20 defines a load strip guide groove or load strip track 30 through which the powder actuated load strip is guided in a designated direction through the powder-actuated tool. In this known example powder-actuated tool, the powder actuated residue tends to buildup in the load strip guide groove 30 and particularly on the opposing surfaces 40*a* and 40*b* that define the opposite sides of the load strip guide groove 30. This residue build up narrows the width of the load strip guide groove 30 and can prevent the load strip from freely advancing though the load strip guide groove 30 of the load strip receiver 20.

Accordingly, there is a need to provide a powered fastener driving tool and particularly a powder-actuated tool that solves this problem.

SUMMARY

Various embodiments of the present disclosure provide a powered fastener driving tool and particularly a powder-actuated tool that solves the above problem by providing an alternatively configured load strip receiver that provides and defines one or multiple residue pockets for collecting excess residue in the load strip receiver and therefore limits or minimizes the likelihood that residue will build up in and narrow the load strip guide groove.

In various embodiments of the present disclosure, a powder-actuated tool generally includes: (a) a housing assembly including a main compartment assembly and a handle assembly extending from the main compartment assembly; and (b) a load strip receiver positioned in the housing assembly. The load strip receiver defines a load strip guide groove configured to receive a load strip. The load strip receiver includes or defines a plurality of spaced apart residue collecting pockets adjacent to the load strip guide groove that facilitate collection of the powder actuated residue away from the load strip guide groove, and particularly away from the opposing surfaces that define the opposite sides of the load strip guide groove. This residue collection prevents or limits the residue build up that narrows the width of the load strip guide groove, and decreases the frequency in which the powder-actuated tool must be cleaned.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
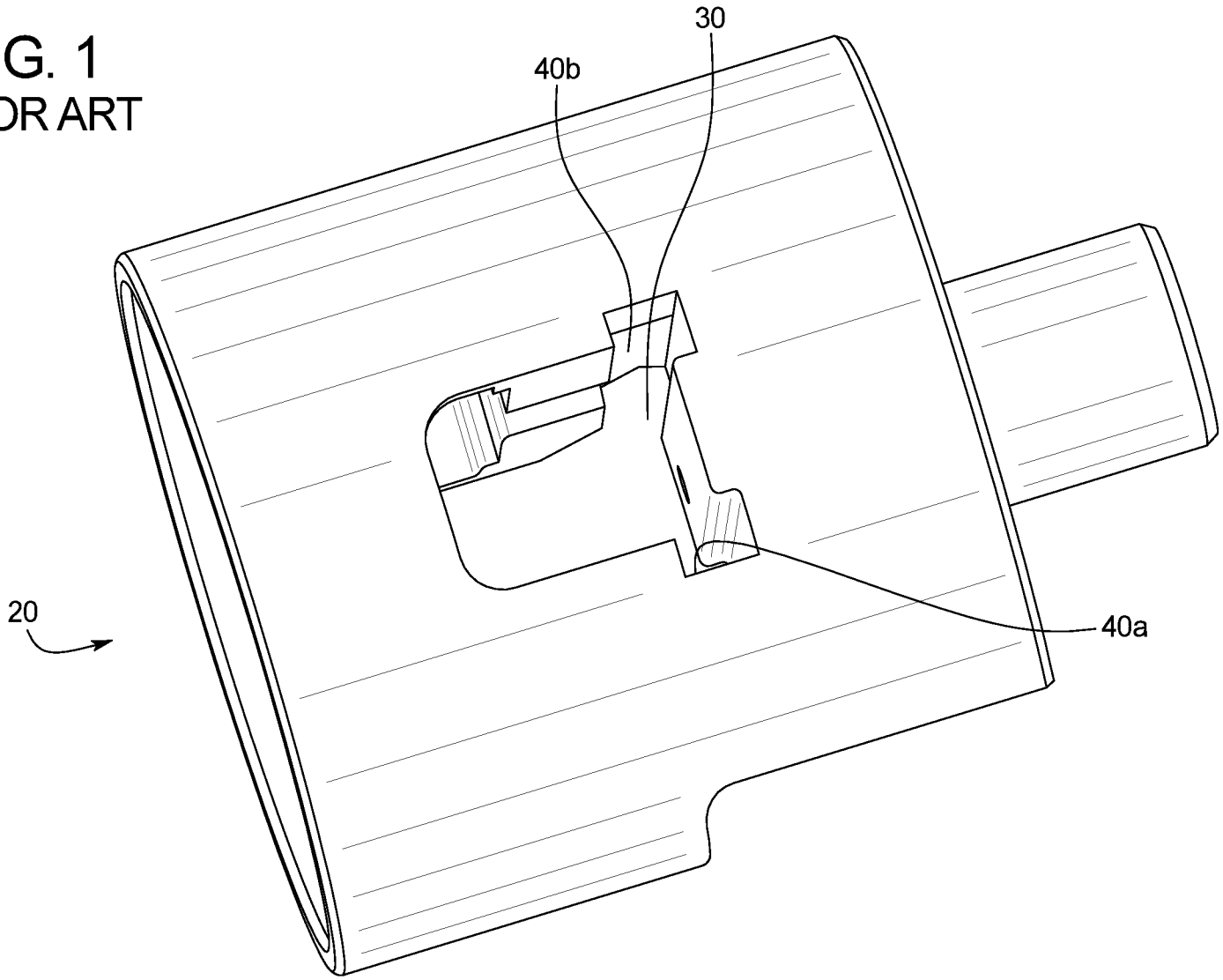
FIG. 1 PRIOR ART
FIG. 1 is a bottom perspective view of a known load strip receiver of a known powder-actuated tool and showing a known load strip guide groove or strip track extending through the load strip receiver and through which the powder actuated load strip is guided in a designated direction through the tool.
Figure 2:
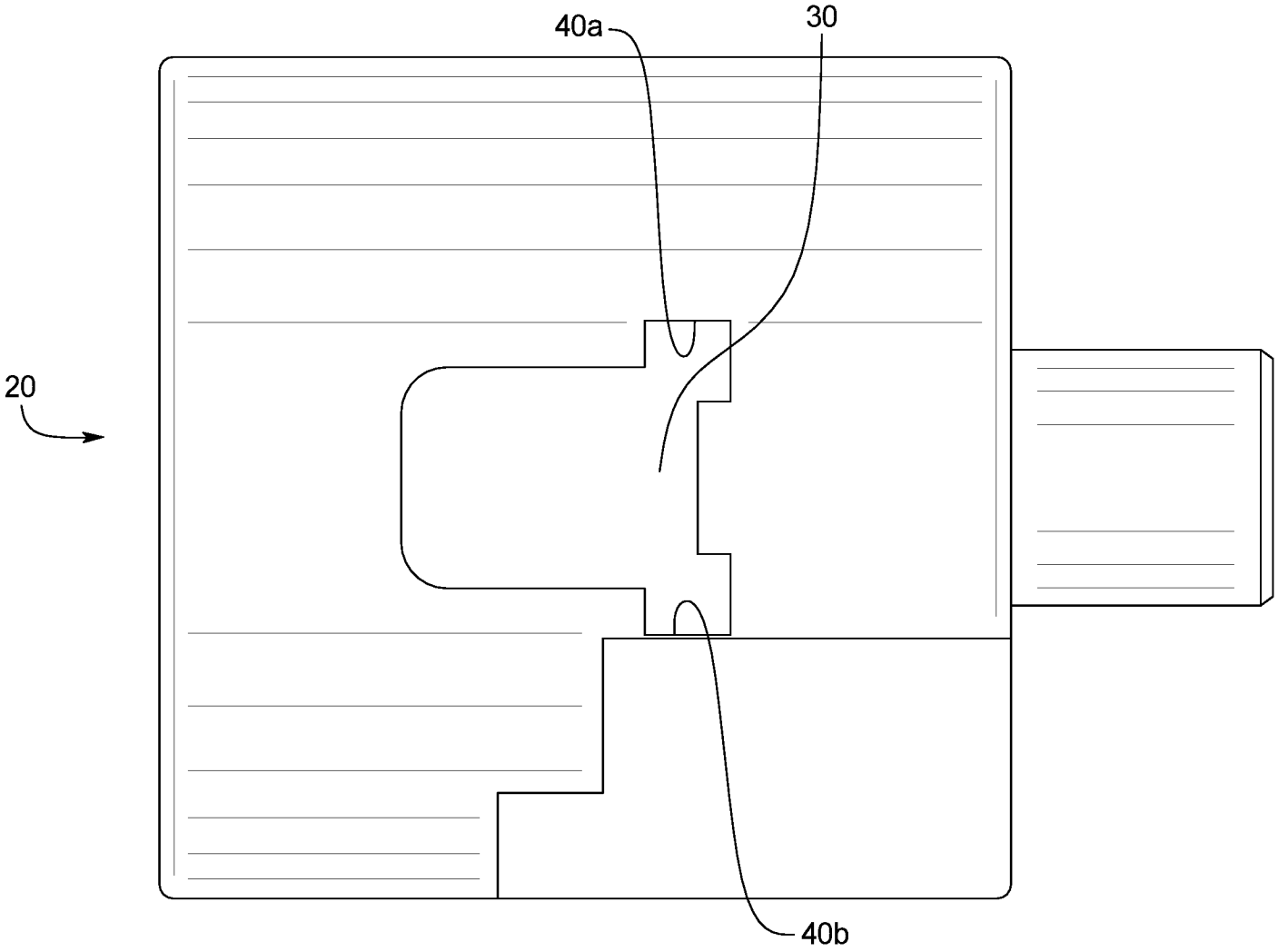
FIG. 2 PRIOR ART
FIG. 2 is a top view of the known load strip receiver of FIG. 1, further showing the known load strip guide groove or strip track through which the powder actuated load strip is guided through the known powder-actuated tool.

Referring now to the drawings, and particularly to FIGS. 3, 4, 5, 6, and 7, the powered fastener driving tool of one example embodiment of the present disclosure is generally illustrated and indicated by numeral 100. The powered fastener driving tool in this illustrated example embodiment is a powder-actuated tool configured to receive a load strip 500. This example powder-actuated tool may be referred to herein as the fastener driving tool, the driving tool, or the tool for brevity. Such abbreviations are not meant to limit the present disclosure in any manner.

Figure 3:
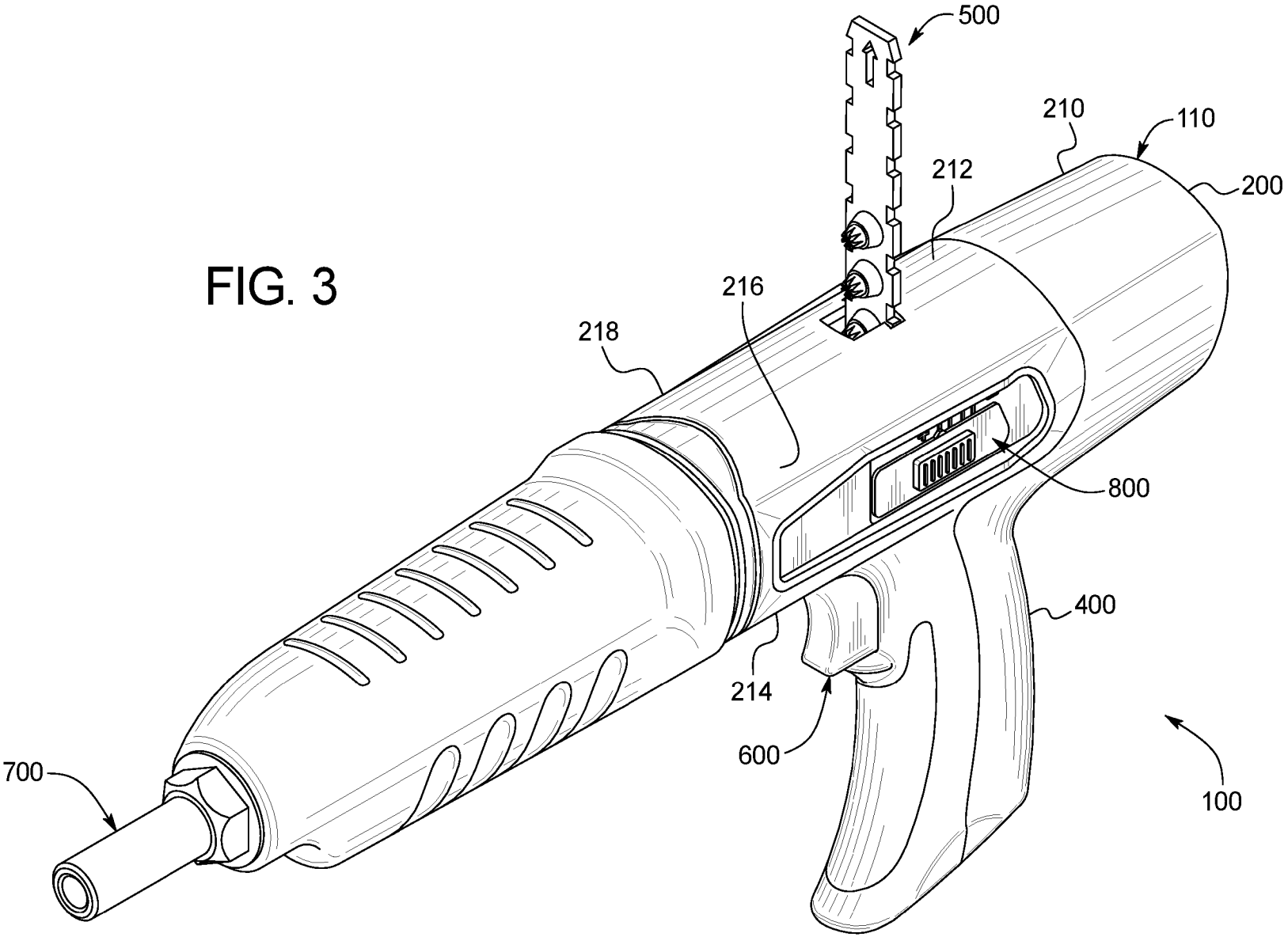
FIG. 3 is a front perspective view of a powered fastener driving tool and particularly a powder-actuated tool of one example embodiment of the present disclosure, and showing a load strip exiting the top of the housing of the powder-actuated tool.
Figure 4:
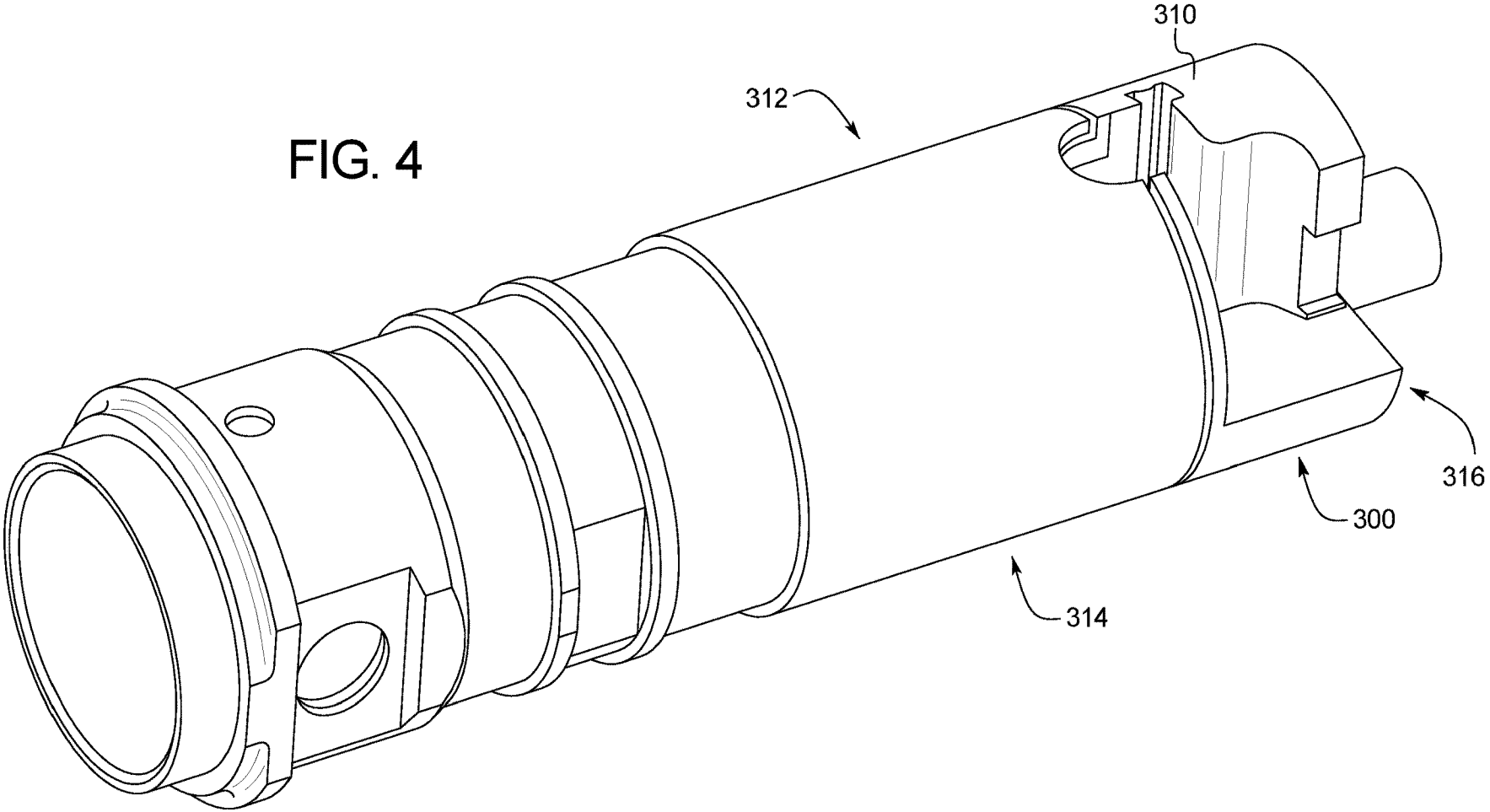
FIG. 4 is a top perspective view of a component configured to be positioned in the housing of the powder-actuated tool of FIG. 3 and including a load strip receiver of the powder-actuated tool of FIG. 3.

The powder-actuated tool 100 of this illustrated example embodiment generally includes: (a) a housing assembly 110 including a main compartment assembly 200 and a handle assembly 400 extending downwardly from the main compartment assembly 200; (b) a suitable power source assembly (including a component partially shown in FIGS. 3, 4, 5, 6, and 7) positioned in the housing assembly 110 and configured to actuate or use loads attached to a load strip 500 that moves upwardly through the handle assembly 400 and main compartment assembly 200 as generally shown in FIG. 3; (c) a suitable fastener supply assembly (not shown) configured to receive fasteners (not shown) and positioned in the housing assembly 110; (d) a trigger mechanism assembly 600 (partially shown) connected to or supported by the handle assembly 400 of the housing assembly 110; (e) a WCE assembly 700 connected to or supported by the housing assembly 110; and (f) a slidable power setting switch 800 partially positioned in and partially extending from the main compartment assembly 200 of the housing assembly 110. It should be appreciated that these components may be arranged in any suitable manner as will be appreciated by one of ordinary skill in the art. These components besides the housing assembly 110 and the power source are not described below in additional detail and may be provided in a conventional or other suitable manner in accordance with the present disclosure.

In this illustrated example embodiment, the main compartment assembly 200 includes a generally tubular outer housing 210 including a top wall 212, a bottom wall 214, a left side wall 216, and a right side wall 218 integrally formed or otherwise suitably connected.

Figure 5:
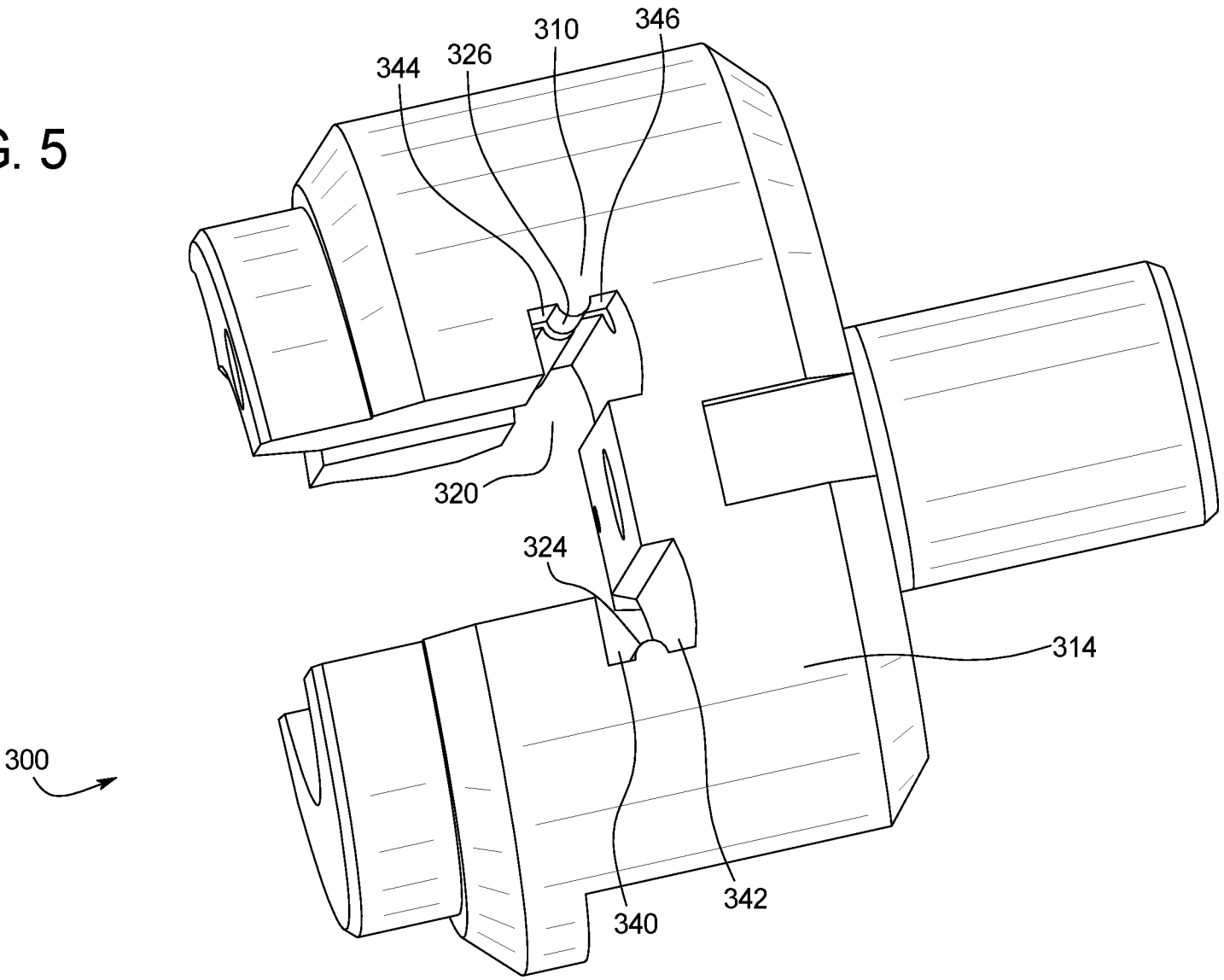
FIG. 5 is bottom perspective view of the load strip receiver of the powder-actuated tool of FIG. 3 removed from the rest of the components.
Figure 6:
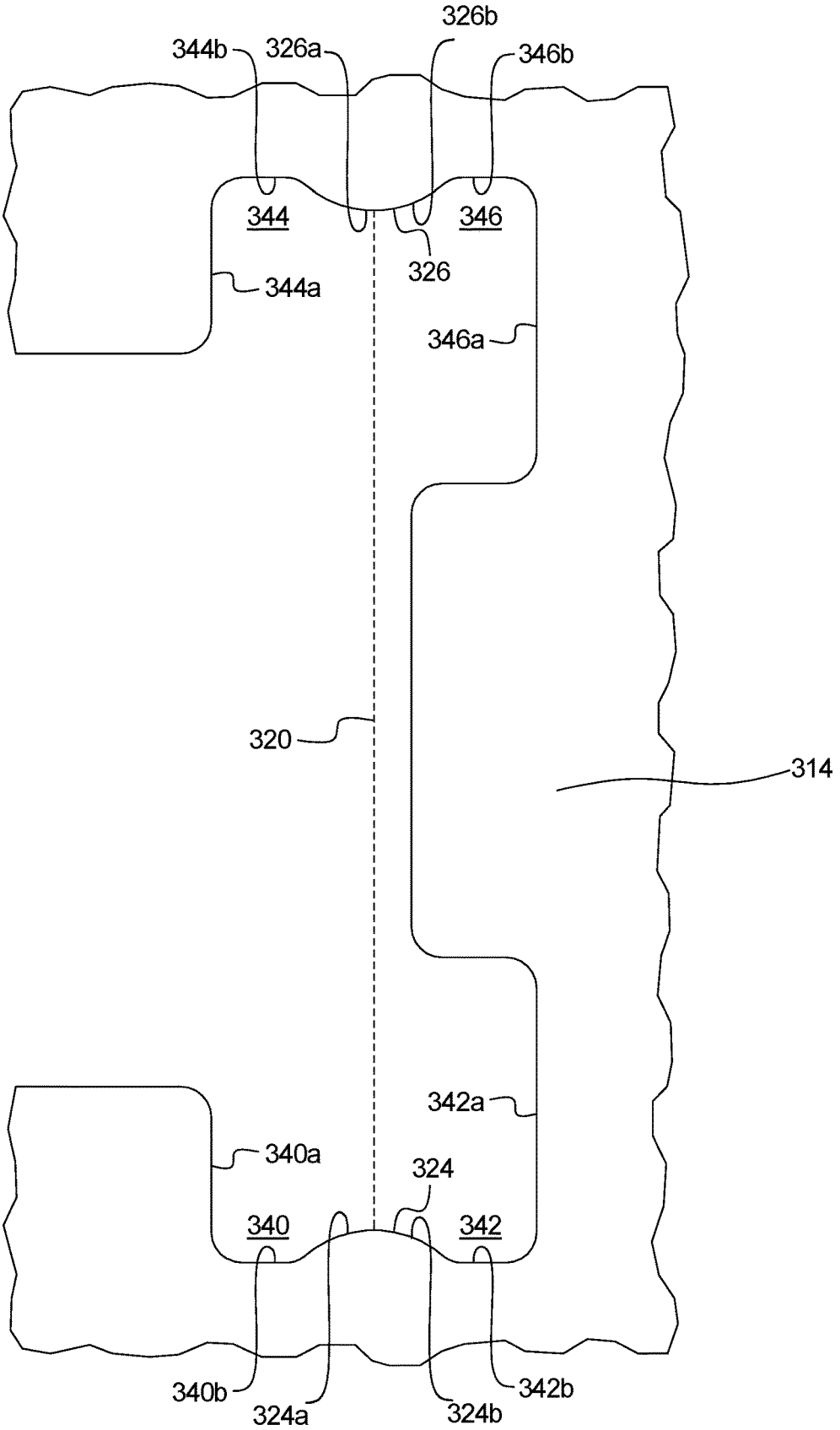
FIG. 6 is an enlarged bottom view of the load strip receiver of the powder-actuated tool of FIG. 3 removed from the rest of the components.
Figure 7:
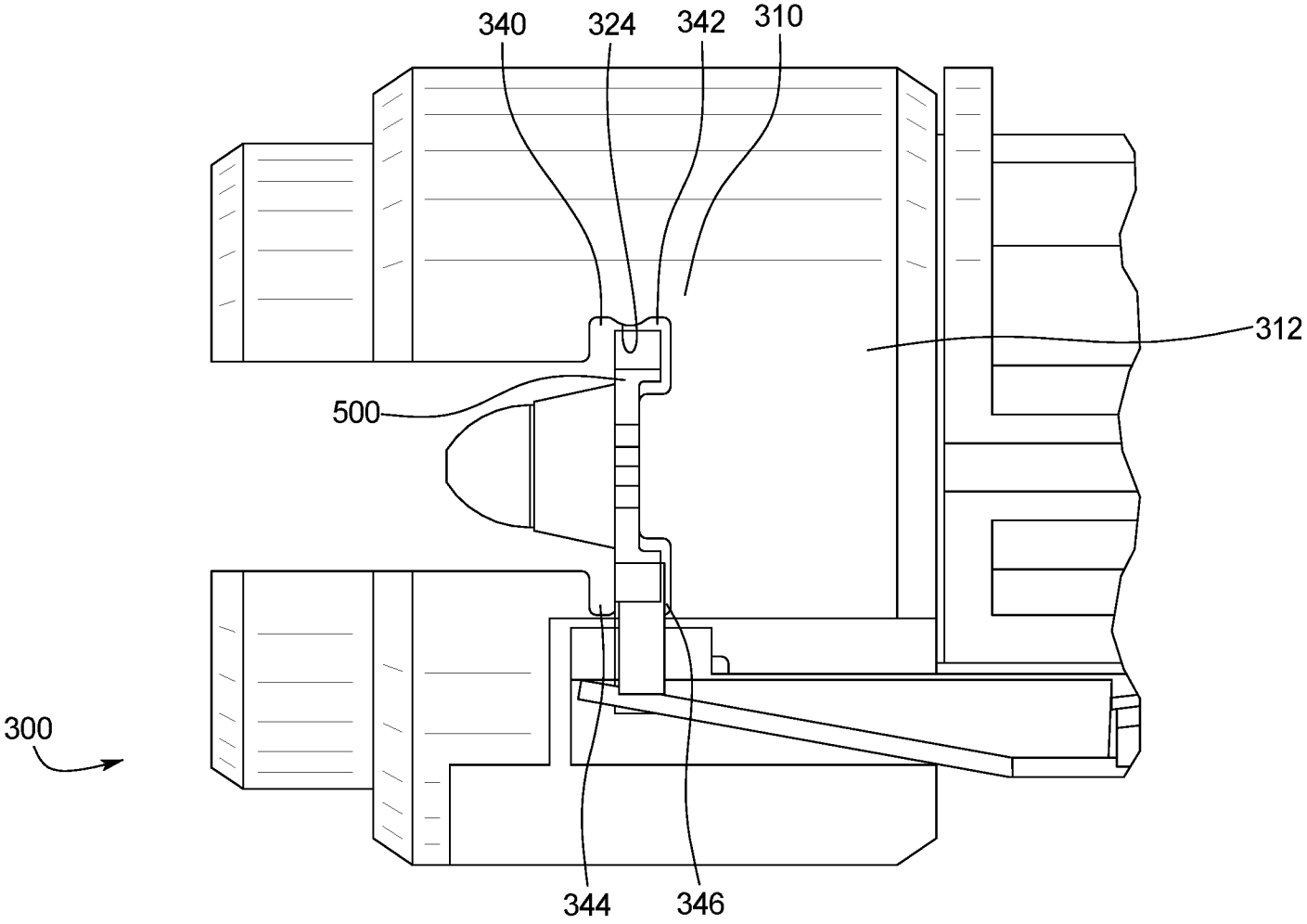
FIG. 7 is top view of the load strip receiver of the powder-actuated tool of FIG. 3, and showing a load strip positioned in the load strip guide groove of the load strip receiver and generally showing the position of a spring-loaded load strip mover engageable with the load strip.

The power source assembly includes a load strip receiver 300 configured to be positioned in the main compartment assembly 200 of the housing 110. The load strip receiver 300 includes a somewhat cylindrical body 310 that generally extends longitudinally within the housing 110. The body 310 of the load strip receiver 300 defines a load strip guide groove or strip track 320 through which the load strips (such as load strip 500 shown in FIG. 7) move through the tool 100. The body 310 of the load strip receiver 300 also defines two pairs of opposing elongated residue collecting pockets 340, 342, 344, and 346 as best shown in FIGS. 5, 6, and 7 in this illustrated example embodiment of the present disclosure.

More specifically, the load strip guide groove or strip track 320 for the guiding load strips is partially defined by two opposing elongated groove defining walls 324 and 326. The two opposing elongated groove defining walls 324 and 326 extend transversely with respect to the body 310 of the load strip receiver 300 and the housing 110. The two opposing elongated groove defining walls 324 and 326 also generally extend toward the bottom and top of the housing 110. The load strip guide groove or strip track 320 is generally indicated in FIG. 6 by the dotted line. In this illustrated embodiment, the elongated groove defining wall 324 is semi-cylindrical and extends all the way through the cylindrical body 310 of the load strip receiver 300 from a bottom side, area, or point 314 of the cylindrical body 310 of the load strip receiver 300 to a top side, area or point 312 of the cylindrical body 310 of the load strip receiver 300. In this illustrated embodiment, the elongated groove defining wall 326 is semi-cylindrical and extends part of the way through the cylindrical body 310 of the load strip receiver 300 from the bottom side, area, or point 314 of the cylindrical body 310 of the load strip receiver 300 to a middle area or point 316 of the cylindrical body 310 of the load strip receiver 300. It should be appreciated that the groove defining walls 324 and 326 can be identical in shape or may have different shapes in accordance with the present disclosure. It should also be appreciated that the groove defining walls 324 and 326 can be other suitable shapes (e.g., the groove defining walls 324 and 326 can have other or varying suitable cross-sections).

The elongated residue collecting pocket 340 transversely extends all the way through the cylindrical body 310 of the load strip receiver 300 from the bottom side, area, or point 314 of the cylindrical body 310 of the load strip receiver 300 to the top side, area or point 312 of the cylindrical body 310 of the load strip receiver 300. The elongated residue collecting pocket 340 is partly defined by two elongated connected walls 340*a* and 340*b* and partially defined by a first side portion 324*a* of elongated groove defining wall 324.

The elongated residue collecting pocket 342 transversely extends all the way through the cylindrical body 310 of the load strip receiver 300 from the bottom side, area, or point 314 of the cylindrical body 310 of the load strip receiver 300 to the top side, area or point 312 of the cylindrical body 310 of the load strip receiver 300. The elongated residue collecting pocket 342 is partly defined by two elongated connected walls 342*a* and 342*b* and partially defined by a second side portion 324*b* of elongated groove defining wall 324.

The elongated residue collecting pocket 344 transversely extends part of the way through the cylindrical body 310 of the load strip receiver 300 from the bottom side, area, or point 314 of the cylindrical body 310 of the load strip receiver 300 to the middle area or point 316 of the cylindrical body 310 of the load strip receiver 300. The elongated residue collecting pocket 344 is partly defined by two elongated connected walls 344*a* and 344*b* and partially defined by a first side portion 326*a* of elongated groove defining wall 326.

The elongated residue collecting pocket 346 transversely extends part of the way through the cylindrical body 310 of the load strip receiver 300 from the bottom side, area, or point 314 of the cylindrical body 310 of the load strip receiver 300 to the middle area or point 316 of the cylindrical body 310 of the load strip receiver 300. The elongated residue collecting pocket 346 is partly defined by two elongated connected walls 346*a* and 346*b* and partially defined by a second side portion 326*b* of elongated groove defining wall 326.

The pockets 340 and 342 are spaced apart from each other on opposite sides of the guide groove 320. The pockets 344 and 346 are spaced apart from each other on opposite sides of the guide groove 320. The pockets 340 and 344 are spaced apart from each other in front of the guide groove 320. The pockets 342 and 346 are spaced apart from each other in back of the guide groove 320.

These pockets 340, 342, 344, and 346 enable the residue to build up in areas slightly outside of where the load strip advances through the load strip receiver of the powder actuated tool. Specifically, pockets 340 and 344 are slightly in front of the load strip guide groove 320 and pockets 342 and 346 are slightly behind the load strip guide groove 320. The load strip receiver 300 thus provides pockets for collection of residue from the activation of the loads of the load strip 500 in the front of and behind the load strip 500. This configuration thus prevents the buildup of residue in undesired spots or locations in the powder-actuated tool and particularly in the guide groove 320 provided by the load strip receiver 300. This configuration also prevents or minimizes damage to those components and reduces the frequency of cleaning need for the powder-actuated tool, and also minimizes the powder-actuated tool becoming less functional, partially inoperable, or completely inoperable from such residue buildup. This configuration extends the timeframe needed for maintenance to remove the residue from the guide groove or strip track. In this illustrated example embodiment, the width of the guide groove generally remains the same to suitably guide the load strip. The pockets 340, 342, 344, and 346 also collect the residue without interfering in the advancement of the load strip through the load strip guide groove.

It should be appreciated that in this example embodiment, the example load strip receiver 300 provides an area for a suitable advancement mechanism for the load strip. It should be appreciated that the size of the area may vary in accordance with the present disclosure. It should also be appreciated that the advancement mechanism of the tool may vary and that load strip receiver may not need to provide such an area for the advancement mechanism in accordance with the present disclosure. In certain such embodiments, all of the residue collection pockets may extend from bottom to top of the load strip receiver.

It should be appreciated from the above that the present disclosure provides a powder-actuated fastener driving tool comprising: a housing assembly including a main compartment assembly and a handle assembly extending from the main compartment assembly; and a strip receiver positioned in the housing, the strip receiver including: a first guide groove defining wall, an opposing second guide groove defining wall, the first guide groove defining wall and the opposing second guide groove defining wall partially defining a guide groove and configured to guide a load strip to move through the strip receiver and the housing, and a plurality of residue collection pocket defining walls that partially define at least a first residue collection pocket.

In various such embodiments of the powder-actuated fastener driving tool, the first guide groove defining wall is semi-cylindrical and extends through the load strip receiver from a bottom side of the load strip receiver to a top side of the load strip receiver.

In various such embodiments of the powder-actuated fastener driving tool, the second guide groove defining wall is semi-cylindrical and extends part of the way through the load strip receiver from the bottom side of the load strip receiver to a middle area of the load strip receiver.

In various such embodiments of the powder-actuated fastener driving tool, the first residue collecting pocket extends through the load strip receiver from the bottom side of the load strip receiver to the top side of the load strip receiver.

In various such embodiments of the powder-actuated fastener driving tool, the plurality of residue collection pocket defining walls partially define the first residue collection pocket adjacent to the guide groove.

In various such embodiments of the powder-actuated fastener driving tool, the plurality of residue collection pocket defining walls partially define the first residue collection pocket extending through the load strip receiver from the bottom side of the load strip receiver to the top side of the body of the load strip receiver.

In various such embodiments of the powder-actuated fastener driving tool, the plurality of residue collection pocket defining walls partially define the first residue collection pocket adjacent to the guide groove.

In various such embodiments of the powder-actuated fastener driving tool, the first residue collection pocket adjacent to the guide groove is also partially defined by a first side portion of the first groove defining wall.

In various such embodiments of the powder-actuated fastener driving tool, the plurality of residue collection pocket defining walls partially define the first residue collection pocket, a second residue collection pocket, a third residue collection pocket, and a fourth residue collection pocket, wherein the first and second residue collection pockets are spaced apart from each other on opposite sides of the guide groove, the third and fourth residue collection pockets are spaced apart from each other on opposite sides of the guide groove, the first and third residue collection pockets are spaced apart from each other in front of the guide groove, and the second and fourth residue collection pockets are spaced apart from each other in back of the guide groove.

It should also be appreciated from the above that the present disclosure provides a powder-actuated fastener driving tool comprising: a housing assembly including a main compartment assembly and a handle assembly extending from the main compartment assembly; and a strip receiver positioned in the housing, the strip receiver including: a first guide groove defining wall, an opposing second guide groove defining wall, the first guide groove defining wall and the opposing second guide groove defining wall partially defining a guide groove and configured to guide a load strip to move through the strip receiver and the housing, and a plurality of residue collection pocket defining walls that partially define a plurality of spaced apart residue collection pockets.

In various such embodiments of the powder-actuated fastener driving tool, at least one of the residue collecting pockets extends through the load strip receiver from a bottom side of the load strip receiver to a top side of the load strip receiver.

In various such embodiments of the powder-actuated fastener driving tool, at least one of the residue collecting pockets extends through the load strip receiver from a bottom side of the load strip receiver to a middle area of the load strip receiver.

It should also be appreciated from the above that the present disclosure provides a powder-actuated fastener driving tool comprising: a housing assembly including a main compartment assembly and a handle assembly extending from the main compartment assembly; and a strip receiver positioned in the housing, the strip receiver including: a first guide groove defining wall, an opposing second guide groove defining wall, the first guide groove defining wall and the opposing second guide groove defining wall partially defining a guide groove and configured to guide a load strip to move through the strip receiver and the housing, and a first plurality of residue collection pocket defining walls that partially define a first residue collection pocket on a first side of the first guide groove defining wall, a second plurality of residue collection pocket defining walls that partially define a second residue collection pocket on a second side of the first guide groove defining wall, a third plurality of residue collection pocket defining walls that partially define a third residue collection pocket on a first side of the second guide groove defining wall, and a fourth plurality of residue collection pocket defining walls that partially define a fourth residue collection pocket on a second side of the second guide groove defining wall, In various such embodiments of the powder-actuated fastener driving tool, each of the first and second residue collecting pockets extends through the load strip receiver from a bottom side of the load strip receiver to a top side of the load strip receiver.

In various such embodiments of the powder-actuated fastener driving tool, each of the third and fourth residue collecting pockets extends through the load strip receiver from a bottom side of the load strip receiver to a middle area of the load strip receiver.

In various such embodiments of the powder-actuated fastener driving tool, the first guide groove defining wall also partially defines each of the first and second residue collecting pockets.

In various such embodiments of the powder-actuated fastener driving tool, the second guide groove defining wall also partially defines each of the third and fourth residue collecting pockets.

It will be understood that modifications and variations may be effected without departing from the scope of the novel concepts of the present invention, and it is understood that this application is to be limited only by the scope of the claims.

The invention is claimed as follows:

1. A powder-actuated fastener driving tool comprising:

a housing assembly including a main compartment assembly defining a tubular outer housing including a top wall, a bottom wall opposite the top wall, a left side wall, and a right side wall opposite the left side wall;

a handle assembly extending from the bottom wall of the main compartment assembly; and a load strip receiver positioned in the main compartment assembly of the housing assembly, the load strip receiver including:

a first guide groove defining wall, an opposing second guide groove defining wall, the first guide groove defining wall and the opposing second guide groove defining wall partially defining a guide groove and configured to guide a load strip to move through the load strip receiver and the outer housing, wherein the first guide groove defining wall and the second guide groove defining wall each extend inwardly toward each other, and a plurality of residue collection pocket defining walls that partially define at least a first residue collection pocket and a third residue collection pocket, wherein the first residue collection pocket extends through the load strip receiver from a bottom side of the load strip receiver to a top side of the load strip receiver, and wherein the third residue collection pocket extends part of the way through the load strip receiver from the bottom side of the load strip receiver to a middle area of the load strip receiver.

2. The powder-actuated fastener driving tool of claim 1, wherein the first guide groove defining wall is semi-cylindrical and extends through the load strip receiver from the bottom side of the load strip receiver to the top side of the load strip receiver.

3. The powder-actuated fastener driving tool of claim 2, wherein the second guide groove defining wall is semi-cylindrical and extends part of the way through the load strip receiver from the bottom side of the load strip receiver to the middle area of the load strip receiver.

4. The powder-actuated fastener driving tool of claim 3, wherein the plurality of residue collection pocket defining walls partially define the first residue collection pocket adjacent to the guide groove.

5. The powder-actuated fastener driving tool of claim 3, wherein the plurality of residue collection pocket defining walls partially define the first residue collection pocket extending through the load strip receiver from the bottom side of the load strip receiver to the top side of the load strip receiver.

6. The powder-actuated fastener driving tool of claim 1, wherein the plurality of residue collection pocket defining walls partially define the first residue collection pocket adjacent to the guide groove.

7. The powder-actuated fastener driving tool of claim 6, wherein the first residue collection pocket adjacent to the guide groove is also partially defined by a first side portion of the first groove defining wall.

8. The powder-actuated fastener driving tool of claim 1, wherein the plurality of residue collection pocket defining walls partially define the first residue collection pocket, a second residue collection pocket, the third residue collection pocket, and a fourth residue collection pocket, wherein the first and second residue collection pockets are spaced apart from each other on opposite sides of the guide groove, the third and fourth residue collection pockets are spaced apart from each other on opposite sides of the guide groove, the first and third residue collection pockets are spaced apart from each other in front of the guide groove, and the second and fourth residue collection pockets are spaced apart from each other in back of the guide groove.

9. The powder-actuated fastener driving tool of claim 8, wherein the first and the second residue collection pockets extend through the load strip receiver from the bottom side of the load strip receiver to the top side of the load strip receiver, and wherein the third and the fourth residue collection pockets extend part of the way through the load strip receiver from the bottom side of the load strip receiver to the middle area of the load strip receiver.

10. A powder-actuated fastener driving tool comprising:

a housing assembly including a main compartment assembly defining a tubular outer housing including a top wall, a bottom wall opposite the top wall, a left side wall, and a right side wall opposite the left side wall;

a handle assembly extending from the bottom wall of the main compartment assembly; and a load strip receiver positioned in the main compartment assembly of the housing assembly, the load strip receiver including:

a first guide groove defining wall, an opposing second guide groove defining wall, the first guide groove defining wall and the opposing second guide groove defining wall partially defining a guide groove and configured to guide a load strip to move through the load strip receiver and the outer housing, wherein the first guide groove defining wall and the second guide groove defining wall each extend inwardly toward each other, and a plurality of residue collection pocket defining walls that partially define a plurality of spaced apart residue collection pockets, wherein at least one of the residue collection pockets extends through the load strip receiver from a bottom side of the load strip receiver to a top side of the load strip receiver and at least another one of the residue collection pockets extends part of the way through the load strip receiver from the bottom side of the load strip receiver to a middle area of the load strip receiver.

11. The powder-actuated fastener driving tool of claim 10, wherein at least two of the residue collecting pockets extends through the load strip receiver from the bottom side of the load strip receiver to the top side of the load strip receiver.

12. The powder-actuated fastener driving tool of claim 11, wherein at least two of the residue collecting pockets extend through the load strip receiver from the bottom side of the load strip receiver to the middle area of the load strip receiver.

13. A powder-actuated fastener driving tool comprising:

a housing assembly including a main compartment assembly defining a tubular outer housing including a top wall, a bottom wall opposite the top wall, a left side wall, and a right side wall opposite the left side wall;

a handle assembly extending from the bottom wall of the main compartment assembly; and a load strip receiver positioned in the main compartment assembly of the housing assembly, the load strip receiver including:

a first guide groove defining wall, an opposing second guide groove defining wall, the first guide groove defining wall and the opposing second guide groove defining wall partially defining a guide groove and configured to guide a load strip to move through the load strip receiver and the outer housing, wherein the first guide groove defining wall and the second guide groove defining wall each extend inwardly toward each other, and a first plurality of residue collection pocket defining walls that partially define a first residue collection pocket on a first side of the first guide groove defining wall, a second plurality of residue collection pocket defining walls that partially define a second residue collection pocket on a second side of the first guide groove defining wall wherein each of the first and second residue collecting pockets extends through the load strip receiver from a bottom side of the load strip receiver to a top side of the load strip receiver, a third plurality of residue collection pocket defining walls that partially define a third residue collection pocket on a first side of the second guide groove defining wall, and a fourth plurality of residue collection pocket defining walls that partially define a fourth residue collection pocket on a second side of the second guide groove defining wall, wherein each of the third and fourth residue collecting pockets extends part of the way though the load strip receiver from the bottom side of the load strip receiver to a middle area of the load strip receiver.

14. The powder-actuated fastener driving tool of claim 13, wherein the first guide groove defining wall also partially defines each of the first and second residue collecting pockets.

15. The powder-actuated fastener driving tool of claim 14, wherein the second guide groove defining wall also partially defines each of the third and fourth residue collecting pockets.

* * * * *